US011202492B2

(12) United States Patent
Berhault et al.

(10) Patent No.: US 11,202,492 B2
(45) Date of Patent: Dec. 21, 2021

(54) APPLICATOR FOR APPLYING A COSMETIC OR CARE PRODUCT TO THE EYELASHES OR EYEBROWS

(71) Applicant: L'OREAL, Paris (FR)

(72) Inventors: Alain Berhault, Le Pres Saint Gervais (FR); Eric Caulier, Ferrieres (FR); Audrey Thenin, Meudon (FR)

(73) Assignee: L'OREAL, Paris (FR)

( * ) Notice: Subject to any disclaimer, the term of this patent is extended or adjusted under 35 U.S.C. 154(b) by 378 days.

(21) Appl. No.: 15/104,026

(22) PCT Filed: Dec. 2, 2014

(86) PCT No.: PCT/IB2014/066504
§ 371 (c)(1),
(2) Date: Jun. 13, 2016

(87) PCT Pub. No.: WO2015/087199
PCT Pub. Date: Jun. 18, 2015

(65) Prior Publication Data

US 2016/0360860 A1 Dec. 15, 2016

(30) Foreign Application Priority Data

Dec. 13, 2013 (FR) ..... 13 62582

(51) Int. Cl.
*A45D 40/26* (2006.01)
*A46B 9/02* (2006.01)
*A46B 1/00* (2006.01)

(52) U.S. Cl.
CPC ..... *A45D 40/267* (2013.01); *A46B 1/00* (2013.01); *A46B 9/021* (2013.01); *A46B 2200/1053* (2013.01)

(58) Field of Classification Search
CPC .. A45D 40/262; A45D 40/265; A45D 40/267; A46B 1/00; A46B 9/021; A46B 2200/1053
See application file for complete search history.

(56) References Cited

U.S. PATENT DOCUMENTS 3,862,639 A 1/1975 Schefer et al.
4,565,205 A 1/1986 Taylor
(Continued)

FOREIGN PATENT DOCUMENTS

EP 1 440 629 B1 8/2007
FR 2 886 112 A1 12/2006
(Continued)

OTHER PUBLICATIONS

Mar. 3, 2015 International Search Report issued in International Patent Application No. PCT/IB2014/066504.

*Primary Examiner* — Rachel R Steitz
(74) *Attorney, Agent, or Firm* — Oliff PLC

(57) ABSTRACT

The present invention relates to an applicator (2) for applying a cosmetic or care product to the eyelashes or eyebrows, having a moulded applicator member (8) having: —a core (10) that extends along a longitudinal axis (X), —spikes (18) that are carried by the core and extend from the core, a majority of the spikes being substantially parallel to one another, the core (10) having, at least in cross section, an outwardly concave overall shape, forming a cavity (20), spikes (18) being disposed inside the cavity (20) in the core.

17 Claims, 4 Drawing Sheets

(56) References Cited

U.S. PATENT DOCUMENTS

Figure 1:
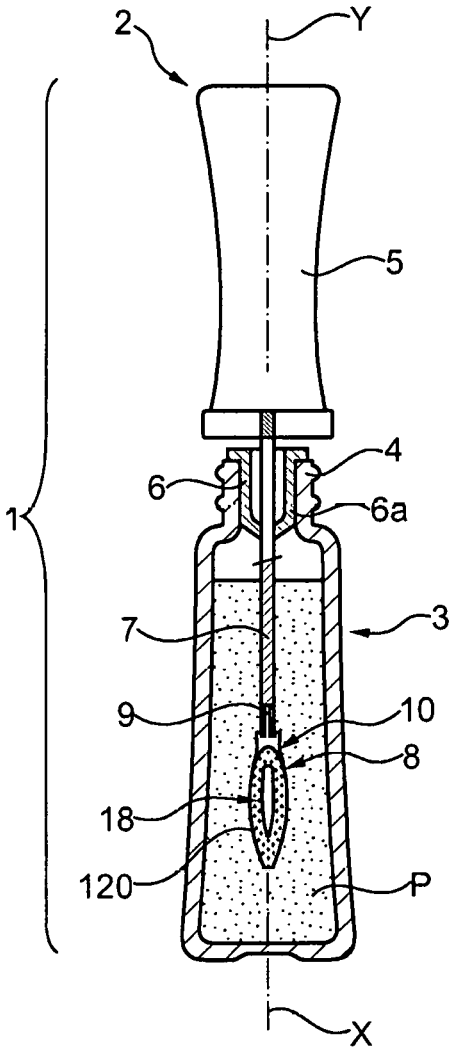

| | | | | |
|---|---|---|---|---|
| 4,974,980 | A | 12/1990 | Gueret | |
| 6,328,495 | B1 | 12/2001 | Gueret | |
| 6,375,374 | B2 | 4/2002 | Gueret | |
| 7,455,468 | B2 | 11/2008 | Gueret | |
| 2004/0258453 | A1 | 12/2004 | Gueret | |
| 2005/0028834 | A1 | 2/2005 | Ramet | |
| 2005/0175394 | A1 | 8/2005 | Gueret | |
| 2006/0279181 | A1* | 12/2006 | Gueret | A45D 40/262 312/218 |
| 2007/0020027 | A1* | 1/2007 | Gueret | A45D 40/262 401/130 |
| 2009/0056737 | A1 | 3/2009 | Neuner et al. | |
| 2011/0094534 | A1* | 4/2011 | Bickford | A45D 34/045 132/218 |
| 2012/0305022 | A1 | 12/2012 | Bickford | |
| 2015/0201737 | A1* | 7/2015 | Roualdes | A45D 40/265 132/200 |

FOREIGN PATENT DOCUMENTS

| | | | |
|---|---|---|---|
| FR | 2 886 113 | A1 | 12/2006 |
| FR | 2 926 446 | A1 | 7/2009 |
| FR | 2 968 906 | A1 | 6/2012 |
| JP | 2009-219630 | A | 10/2009 |

* cited by examiner

APPLICATOR FOR APPLYING A COSMETIC OR CARE PRODUCT TO THE EYELASHES OR EYEBROWS

The present invention relates to applicators for applying a cosmetic, makeup or care, product to the eyelashes or eyebrows, for example mascara. Such an applicator can have a stem and, at one end of the latter, an applicator member for applying the product to the eyelashes or eyebrows. The invention relates more particularly to applicators having a moulded applicator member.

The invention also relates to packaging and application devices having a container containing the product to be applied, and the applicator. The product is picked up in the container, which can be provided with a wiping member for removing the excess product present on the stem and on the applicator member. This wiping member has for example a lip made of an elastomeric material, defining a wiping orifice of circular section, the diameter of which corresponds substantially to that of the stem.

A large number of applicators having a moulded applicator member are known.

Application EP 1 440 629 relates to an applicator having two walls that are arranged in a V-shape and form between one another a slot for distributing the product.

Patent Applications FR 2 926 446, FR 2 968 906 and JP 2009-219630 relate to spoon-shaped applicators which can carry separating elements that converge towards one another. Moreover, in Application FR 2 968 906, a pulverulent product is intended to be applied.

Application U.S. 2009/0056737 relates to a mascara applicator having an applicator member that is curved along its entire length and carries teeth.

There is a need to further improve applicators for applying a product, in particular mascara, to the eyelashes and/or eyebrows, in order to improve the performance thereof, and more particularly to promote the creation on the applicator member of zones that are more heavily laden with product, which allow easy application of makeup and rapid and abundant loading of the eyelashes and/or eyebrows, while retaining a high capacity to separate the eyelashes and/or eyebrows.

Thus, a subject of the invention, according to one of its aspects, is an applicator for applying a cosmetic or care product to the eyelashes or eyebrows, having a moulded applicator member having.

a core that extends along a longitudinal axis, spikes that are carried by the core and extend from the core, a majority of the spikes being substantially parallel to one another, the core having, at least in cross section, an outwardly concave overall shape, forming a cavity, spikes being disposed inside the cavity in the core.

The expression "spikes that are substantially parallel to one another" should be understood as meaning that the elongation axes of the spikes are parallel or slightly inclined with respect to one another at an angle of less than or equal to 15°.

More than two thirds of the spikes may be parallel to one another, better still more than three quarters of the spikes, or even substantially all of the spikes may be parallel to one another. The parallelism between the spikes makes it possible to obtain better combing of the eyelashes, the latter being managed better by the spikes.

The concavity in the core gives the applicator an improved ability to retain and store product, in particular in the cavity. During application, the eyelashes can be immersed in the product, the spikes allowing the eyelashes to be separated after they have been loaded with product. The invention makes it possible to obtain, on the applicator member, in particular in the cavity, at least one zone that forms a reservoir and which acquires a surplus of product on the core after wiping. Specifically, the product cannot be wiped off in the cavity. This surplus product allows the eyelashes and/or eyebrows to be loaded with a large and satisfactory amount of product from the first application.

The expression "longitudinal axis of the core" denotes the line connecting all of the centres of mass of the cross sections of the core. The longitudinal axis may be a central axis, or even an axis of symmetry for the core, in particular when the core has a circular cross section or a cross section in the overall shape of a regular polygon. The longitudinal axis of the core may be rectilinear or curved and may be contained in a plane, which may be a plane of symmetry for some, or even for all of the cross sections of the core. Preferably, the longitudinal axis of the core is rectilinear.

The term "spike" denotes an individualizable projecting element intended to come into engagement with the eyelashes and/or eyebrows.

The core may have an outwardly concave overall shape when viewed in cross section, that is to say in a section extending perpendicularly to the longitudinal axis X of the core.

The core may also have, if appropriate, an outwardly concave overall shape when viewed in longitudinal section, that is to say in a section extending parallel to the longitudinal axis X of the core. The core may have an outwardly concave overall shape both in cross section and in longitudinal section.

In a variant, it is possible for the core only to be concave in cross section and not in longitudinal section. In this case, when it is viewed in longitudinal section, the bottom of the core extends parallel to the longitudinal axis X of the core.

The curvature in cross section of the face defining the concavity in which the spikes are disposed can change along the applicator member, and in particular the face can flatten in the direction of the distal end of the applicator member. The edges of the core which laterally delimit it in top view can be rectilinear along the majority of the length of the applicator member when the latter is viewed from the side perpendicularly to the longitudinal axis of the applicator member.

Some spikes may be partially concealed by the core when the latter is viewed from the side in a direction perpendicular to the longitudinal axis of the core and to the direction of elongation of the spikes.

The core may have at least one lip, in particular two lips, extending substantially longitudinally and laterally delimiting the cavity. The lip or lips tend to prevent wiping of the lower part of the spikes that are located in the vicinity.

The term "lip" denotes a projecting portion of the core that delimits the cavity along the longitudinal axis of the core.

The lip or lips may extend parallel to the longitudinal axis X of the core, or be slightly curved, while having an overall direction parallel to the longitudinal axis X of the core.

The lip or lips at least partially cover the spikes when the applicator is viewed from the side, perpendicularly to the longitudinal axis X of the core, that is to say that the spikes are at least partially non-visible in this configuration, such that the spikes can be at least partially protected during any wiping of the applicator. Storage and application of the product are improved thereby. Moreover, the presence of the lips can make it possible to improve the curling of the eyelashes.

The spikes may project beyond the core when the applicator is viewed in side view perpendicularly to the longitudinal axis X of the core. This allows improved separation of the eyelashes, the spikes largely standing out from the lips and thus being easily accessible during application.

The height of the lip or lips is preferably less than the height of the largest spikes. The expression "height of a lip" denotes the distance measured perpendicularly to the core between the apex of the lip and its base by way of which it is attached to the bottom wall of the core. The expression "height of a spike" denotes the distance measured along the elongation axis of the spike between its free end and its base by way of which it is connected to the core. The expression "elongation axis of the spike" denotes an axis which passes through the centres of mass of the cross sections of the spike.

The ratio l'/l between the height l' of a spike projecting beyond the core viewed in side view and its overall height l may be between 0 and 10 mm, better still between 0.5 and 5 mm.

The height l' may be between 0 and 5 mm.

In a variant, the spikes may be the same height as the edges of the core, being flush with but not projecting beyond said edges. In a further variant, the spikes may be too small to be visible when the applicator is viewed in side view perpendicularly to the longitudinal axis X of the core.

The height of the core may be between 2 mm and 10 mm, better still between 3 mm and 6 mm. The height of the core may be constant along its entire length. Preferably, the height of the core is variable, in particular increasing and then decreasing along the longitudinal axis of the core.

The width e of the lip or lips may be between 2 mm and 15 mm, better still between 3 mm and 10 mm. The expression "width of a lip" denotes the largest transverse dimension of the lip, in section, perpendicularly to the longitudinal axis of the lip.

The lip or lips may be attached to a bottom wall, it being possible for said bottom wall to be planar, concave or convex towards the inside of the cavity, preferably concave. The lip or lips may be attached perpendicularly or obliquely to the bottom wall.

In a further variant, the core may have a cross section with a curved overall shape, without lips.

The face of the core to which the spikes are attached may be non-planar, in particular outwardly concave, in particular when viewed in cross section.

The free end of the spikes may define an envelope surface having an outwardly concave profile when the applicator member is viewed from the side.

The edges of the core may be rectilinear over a major part of the portion of the core carrying spikes, and preferably be contained in a plane perpendicular to the direction of elongation of the spikes.

In a variant, the edges of the core may be non-rectilinear, for example curved. They may for example be curved about at least one axis of curvature, or even two axes of curvature.

The core may have a through-orifice, in particular in the form of a slot that is elongate in the direction of the longitudinal axis of the core. Such an orifice can make it easier to fill the cavity in the core, inasmuch as the product can pass into this cavity through the side away from the spikes present in the cavity. Such an orifice can also make it possible to increase the product storage capacity of the applicator. It can also make it possible to avoid the piston effect while the applicator passes a possible wiping member. The orifice can be located at the bottom of the cavity.

The through-orifice may separate two portions of the core, the spikes being disposed in staggered rows on each portion, the number of rows extending along the axis X and carried by each portion being between 1 and 4, and preferably equal to 3.

In a variant, it is possible for the applicator not to have such a through-orifice.

It is possible for the applicator member not to have spikes on the side away from the concavity in the core, the applicator member in this case only having spikes that are disposed inside the concavity in the core and thus having no spikes at all outside this Concavity.

In a variant, the core may carry spikes on the side away from its concavity. These spikes disposed on the side away from the concavity may be substantially parallel to one another. More than two thirds of the spikes away from the concavity may be parallel to one another, better still more than three quarters of the spikes away from the concavity, or even substantially all of the spikes away from the concavity may be parallel to one another. In a variant, these spikes away from the concavity may be oriented in some other way, for example radially.

The core may have a tapered free end. This tapered end may make it possible to retain a drop of product during removal from the container containing the product. This drop of product may be applied by tapping the eyelid under the eyelashes in order to transfer the product to this location with an eyeliner effect. It is possible for this tip to be flocked or not to be flocked.

At least one of the core and/or the spikes may be covered entirely or partially with flocking.

The lips are preferably moulded together with and from the same material as the rest of the core.

The core and the spikes may be moulded from one and the same material, or in a variant they can be made from at least two different materials. A part of the core and the spikes may for example be made from a first material, and another part of the core and the spikes may be made from a second material which is for example more flexible or harder than the first material. The core is for example formed from one or more thermoplastic materials which may be elastomeric.

The core and/or the spikes may be made of an elastomeric, thermoplastic or thermosetting material, metal or ceramic.

In implementation examples of the invention, the spikes are produced by moulding or overmoulding with the core. The spikes may, for example, be produced by a technique in which a material is injected through at least one part of the core, so as to allow the formation of the spikes.

Spikes

The height of at least one spike, measured from the core, may be between 1 mm and 16 mm, or even between 1.5 mm and 6 mm.

The height of the spikes may vary, for example in a monotonous manner, along the longitudinal axis of the core. For example, along this longitudinal axis, the height of the spikes may increase between the proximal end of the core and a first abscissa, then remain approximately constant between this first abscissa and a second abscissa before decreasing between this second abscissa and the distal end of the core. In a variant, the height of the spikes may decrease and then increase along the longitudinal axis of the core. In a further variant, the height of the spikes may have a constant height over a major part of the length of the applicator member, or even along the entire length of the applicator member, but may appear to decrease and then increase in side view, perpendicularly to the longitudinal axis of the core, given the concavity of the face of the core to which the spikes are attached.

The spikes may differ from one another by way of at least one of their shape, thickness, height, orientation, colour and/or material.

It is possible for the spikes to be perpendicular or not to be perpendicular to the longitudinal axis of the core.

Some spikes of the applicator, or even all the spikes, may have a thickness measured at their base, that is to say at the point at which the spikes are attached to the core, of between 0.2 and 1 mm, or even between 0.3 and 0.7 mm. The expression "thickness of a spike" denotes the largest transverse dimension of the spike, in section, perpendicularly to the elongation axis of the spike. It is a diameter when the spike has a conical overall shape.

The spikes may have any shape. The spikes may have a cylindrical or tapered, in particular conical, frustoconical or pyramidal shape. At least one spike may end with a rounded, in particular hemispherical, free end.

Given the parallelism between the spikes that was mentioned above, and the concave shape of the core, the elongation axis of the spikes may form an angle other than 90° with the surface of the core at the point at which the spikes are attached to the core. In a variant or additionally, at least some spikes may extend from the core along an elongation axis perpendicular to the surface of the core at the point at which the spike is attached to the core.

The applicator may have between 10 and 200 spikes, for example between 30 and 150 spikes.

Applicator

According to one implementation example of the invention, the applicator member is moulded within a mould formed by the assembly of a plurality of shells.

The applicator may have a stem that carries the applicator member at a first end and is fixed to a gripping member at a second end.

The core may be solid, being for example moulded with an end piece for fixing to the stem of the applicator.

The applicator member may be fixed to the stem by snap-fastening, adhesive bonding, welding, crimping, pressing, stapling, force-fitting, fitting in a cold state or fitting in a hot state, for example by being mounted in a housing in the stem. In a variant, the stem may be received in a housing provided in the core.

It is also possible for the stem and the applicator member to be moulded or not to be moulded in one piece and from the same thermoplastic material.

The spikes may be made of a material that is more or less rigid than a material used to produce the stem of the applicator to which the core is attached.

The applicator member may have a mounting end piece that is moulded in one piece with the cute and may have, if appropriate, one or more narrowed portions that improve the flexibility of the applicator and the smoothness of application.

The core may extend along a longitudinal axis which, at at least one point along its length, forms an angle with the longitudinal axis of the stem to which the core is fixed. The applicator member may be angled at its attachment to the stem.

The stem may have a first, rigid portion that is extended on the distal side by a second, more flexible portion, for example made of elastomer, that carries the applicator member.

A largest transverse dimension of the core may be smaller than, larger than or equal to a largest transverse dimension of the stem.

The visible height of the applicator member may be between 2 mm and 15 mm, better still between 3 mm and 10 mm. The expression "visible height" should be understood as meaning the total height of the applicator member, measured perpendicularly to the longitudinal axis. It is measured between the point of the applicator member that is farthest from the axis on one side of the axis and the point farthest from the axis on the other side of the axis.

Application Device

A further subject of the invention is a device for packaging and applying a product to the eyelashes and/or eyebrows, having an applicator according to the invention and a container containing the product. The product is preferably a mascara.

The gripping member of the applicator may form a cap for closing the container.

The container may have a wiping member suitable for wiping the stem and the applicator member.

A further subject of the invention, according to another of its aspects, is a process for making up the eyelashes or eyebrows, comprising the step of applying a cosmetic product to the eyelashes or eyebrows with the aid of an applicator member according to the invention, as defined above.

Figure 2:
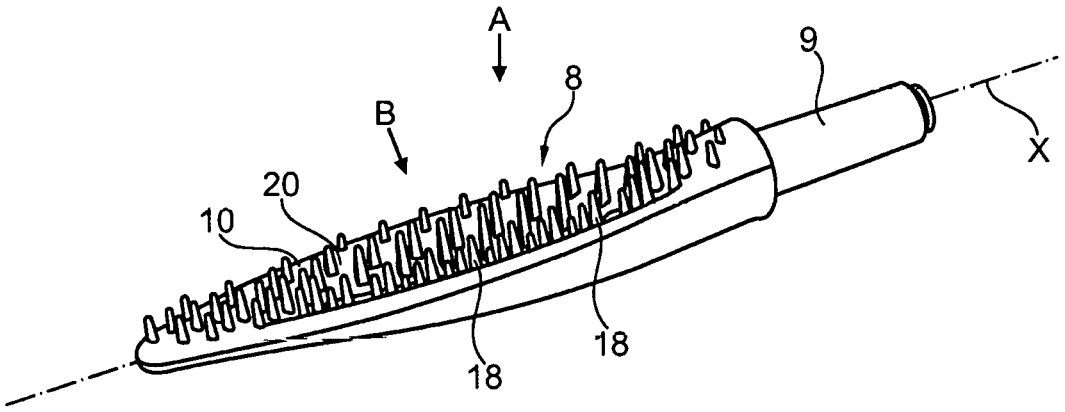
Figure 3A:
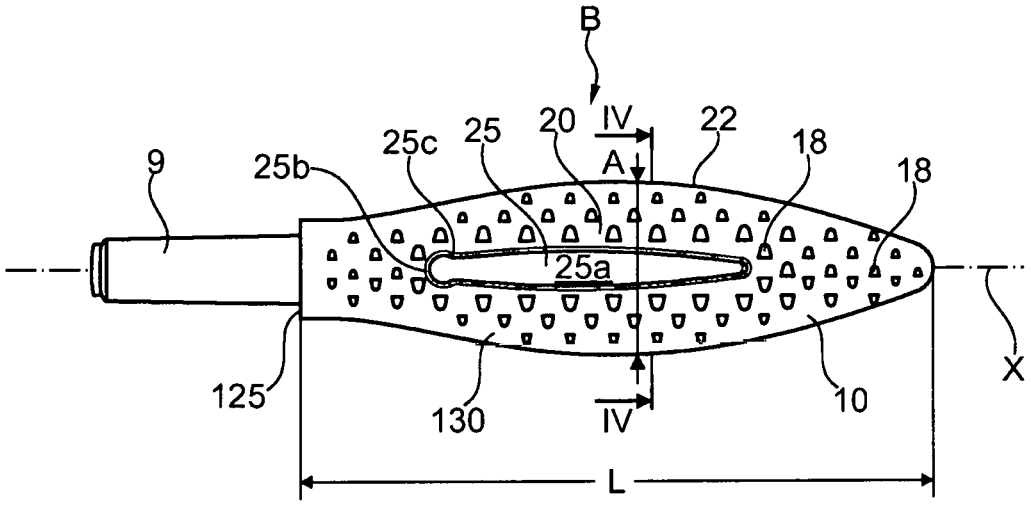
Figure 3B:
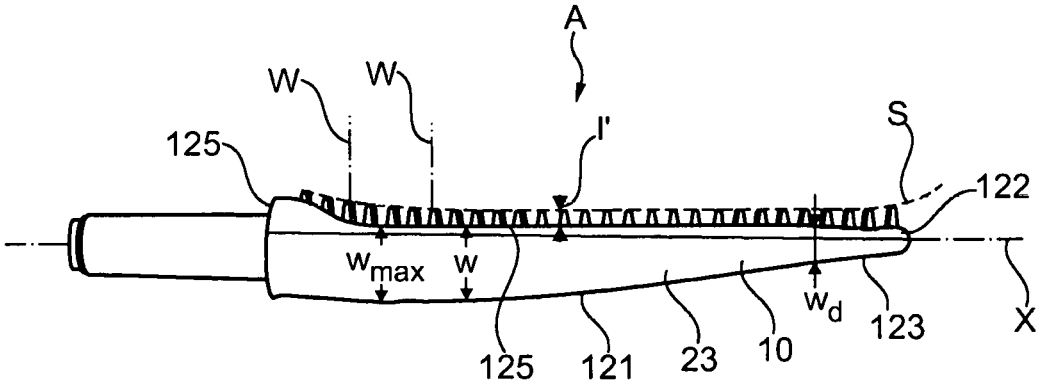
Figure 4:
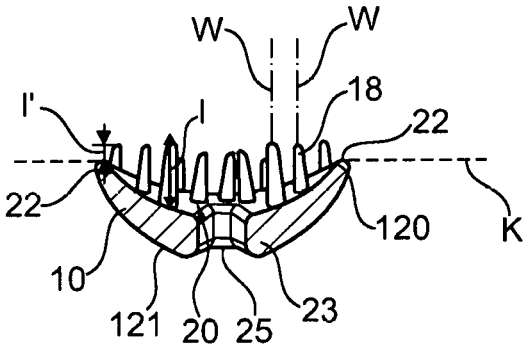
Figure 10:
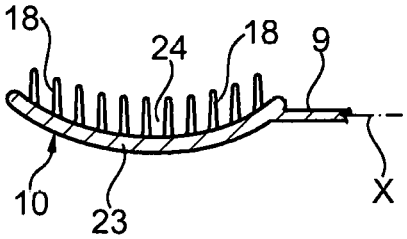
Figure 10A:
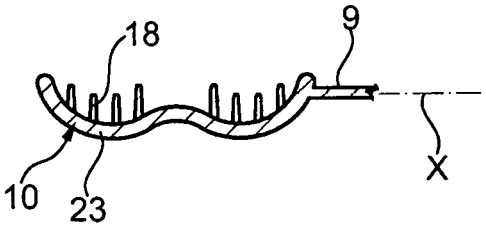
Figure 10B:
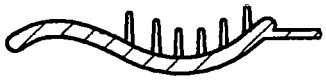
Figure 11:
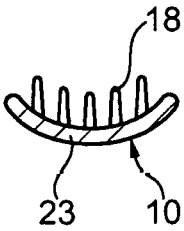
Figure 12:
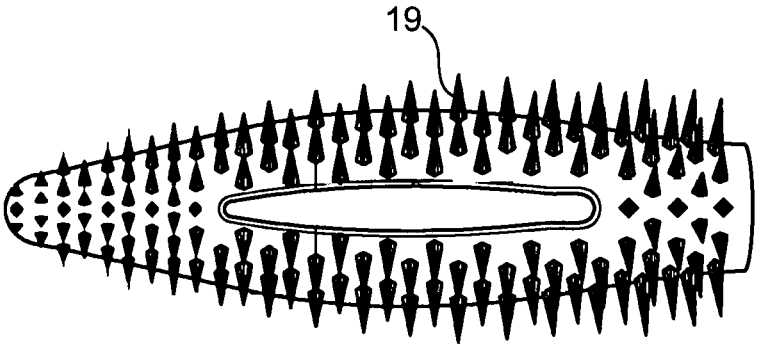
Figure 13:
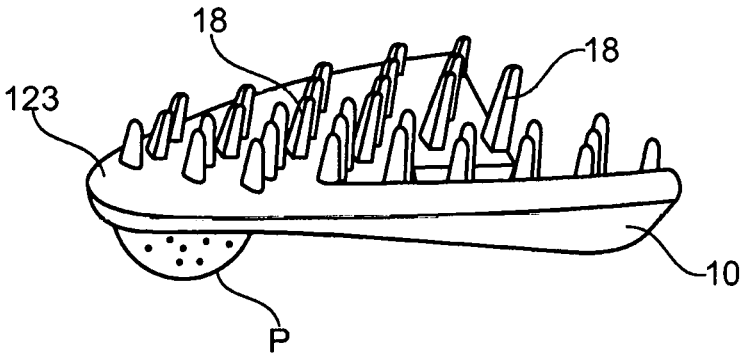

The invention may be better understood from reading the following detailed description of nonlimiting implementation examples thereof, and with reference to the attached drawing, in which:

FIG. 1 is a schematic elevation view, in partial longitudinal section, of an exemplary packaging and application device produced in accordance with the invention, FIG. 2 shows a perspective view of the applicator member from FIG. 1 on its own, FIGS. 3*a* and 3*b* are views along the arrows A and B, respectively, of the applicator member from FIGS. 1 and 2, FIG. 4 is a cross section through the applicator member from FIGS. 1 and 2, FIGS. 5 to 8 and 11 are views similar to FIG. 4 of variant embodiments, FIGS. 9, 10, 10*a* and 10*b* are longitudinal sections through variant embodiments, FIG. 12 is a view, similar to FIG. 2, of a variant embodiment of an applicator member according to the invention, and FIG. 13 is a view, similar to FIG. 2, illustrating the use of the device.

FIGS. 1, 2, 3*a*, 3*b* and 4 show a packaging and application device 1 produced in accordance with the invention, having an applicator 2 and an associated container 3 containing a product P to be applied to the eyelashes and/or eyebrows, for example a makeup product such as mascara or a care product.

The container 3 has, in the example in question, a threaded neck 4 and the applicator 2 has a closure cap 5 designed to be fixed on the neck 4 so as to close the container 3 in a sealed manner when it is not in use, the closure cap 5 also forming a gripping member for the applicator 2.

The applicator 2 has a stem 7 of longitudinal axis Y, which is attached at its upper end to the closure cap 5 and at its lower end to an applicator member 8. The latter has a core 10 that carries spikes 18 that extend from the core 10.

The container 3 also has a wiping member 6, for example inserted into the neck 4. This wiping member 6, which may be any wiping member, has, in the example in question, a lip designed to wipe the stem 7 and the applicator member 8 when the applicator 2 is withdrawn from the container 3. The lip defines a wiping orifice 6*a* having a diameter adapted to that of the stem.

In the example illustrated, the stem 7 has a circular cross section, but if the stem 7 has some other section, this does not depart from the scope of the present invention, it then being possible to fix the cap 5 on the container 3 in some other way than by screwing, if necessary. The wiping member 6 is adapted to the shape of the stem 7 and to that of the applicator member 8, if appropriate.

Preferably, and as in the example in question, the longitudinal axis Y of the stem 7 is rectilinear and coincident with the longitudinal axis of the container 3 when the applicator 2 is in place thereon, but if the stem 7 is not rectilinear, forming for example an elbow, this does not depart from the scope of the present invention.

If need be, the stem 7 may have an annular narrowing at its portion that is positioned opposite the lip of the wiping member 6, so as not to mechanically stress the latter unduly during storage.

The applicator member 8 may be fixed to the stem 7 by any means, and in particular by force-fitting, snap-fastening, adhesive bonding, welding, stapling or crimping, in a corresponding housing provided at the end of the stem 7.

As illustrated in FIG. 2, the applicator member 8 may have an end piece 9 for fixing it in a corresponding housing in the stem 7, optionally in an aligned manner.

In a variant, the stem 7 may be inserted into a housing provided in the core 10. The core 10 may also be produced in one piece with the stem 7 by being moulded together therewith.

With reference to FIG. 2, it can be seen that the core 10 has a shape that is elongate along a longitudinal axis X, being rectilinear in the example described. The longitudinal axis X may be central, as illustrated.

The visible length L of the applicator member 8 is for example between 5 mm and 40 mm, better still between 10 mm and 30 mm.

In the example shown, the spikes 18 each extend from the core 10 along an elongation axis W perpendicular to the longitudinal axis X of the core, such that all the spikes are parallel to one another. In one variant which is not shown, the elongation axis W of some of the spikes 18 forms an angle other than 90° with the longitudinal axis X of the core or with a plane containing this axis.

Furthermore, the core 10 has, both in cross section and in longitudinal section, an outwardly concave overall shape, forming a cavity 20. In other words, the core 10 has the overall shape of a spoon, having, in top view, a width which increases and then decreases along the longitudinal axis X of the core, with a distal end that tapers.

The spikes 18 are disposed inside the cavity 20 defined by the double concavity in the core 10.

Where the core 10 is concave in cross section, the core 10 is defined by two upright portions 22 that are curved upwardly in FIG. 4 and which narrow in the direction of their free edge.

In the example described, the visible height of the core, when viewed from the side as in FIG. 3*b*, decreases in the direction of its distal end.

The upright portions 22 at least partially conceal the spikes 18 when the applicator is viewed from the side, perpendicularly to the longitudinal axis X of the core, as illustrated in FIG. 3*b*. The spikes 18 are only partially visible in this configuration, such that they are at least partially protected during the wiping of the applicator.

Furthermore, as illustrated in FIG. 4, the depth of the cavity is less than the Height l of the spikes, such that the latter project beyond the core by a height l' when the applicator is viewed in side view perpendicularly to the longitudinal axis X of the core, as in FIG. 3*b*. Thus, improved separation of the eyelashes is obtained, the spikes largely standing out from the core and thus being easily accessible during application.

The height l' of the spikes projecting beyond the core may be variable, for example decreasing and then increasing along the longitudinal axis X, as illustrated, or else increasing and then decreasing. The height l' may also be constant.

It can be seen in FIG. 3*b* that the upper edges 120 of the upright portions 22 can be rectilinear when the applicator member is viewed from the side. The upper edges 120 may be contained in a plane K substantially parallel to the longitudinal axis X.

The profile of the opposite face 121 of the core may be outwardly convex in cross section, as illustrated in FIG. 4.

When viewed from the side, the profile of the face 121 may be convex with an inflection towards the distal end 122.

The height w of the core, when the applicator member is viewed from the side, can vary along the portion that carries the spikes 18, as illustrated in FIG. 3*b*, decreasing towards the distal end 122. This can allow the face 121, which forms the back of the applicator member, to accumulate surplus product in the least thick zone 123, close to the end 122, it being possible for this surplus product to be useful for makeup, as illustrated in FIG. 13.

The height w can vary from a maximum value $w_{max}$ at a point on the length L of the core that is located for example in the rear quarter starting from the proximal end 125 of the core, to a value $w_d$ at L/8 from the distal end 122, where $$\frac{w_{max}}{w_d} \geq 2,$$

preferably.

The proximal end 125 of the core is defined by the shoulder for attaching the end piece 9.

The width t of the core 10, when viewed from above as in FIG. 3*a*, varies along said core, and is for example at a maximum approximately half-way along the core, for example between L/2−L/8 et L/2+L/8 from its proximal end 125 or from its distal end 122.

Figure 5:
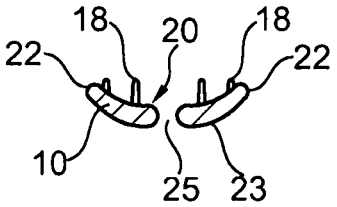

In the variant embodiment illustrated in FIG. 5, the spikes are not visible when the applicator is viewed in side view perpendicularly to the longitudinal axis X of the core, along the arrow B. The spikes do not project beyond the upper edges of the core.

In the examples which have just been described, the overall shape of the core is curved in cross section, the upper edges of the core being defined by the upper end of the upright portions 22.

Figure 6:
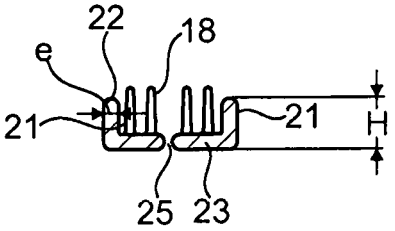
Figure 7:
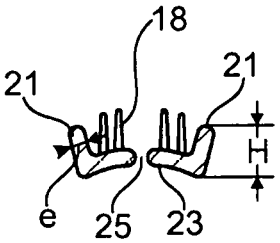
Figure 8:
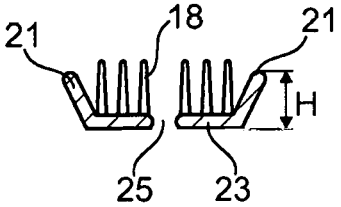

In a variant, the core may have a bottom wall 23 to which upright portions 22 are attached in the form of lips 21, as illustrated in FIGS. 6 and 7, respectively. The lip or lips 21 may be attached perpendicularly or obliquely to the bottom wall 23, as illustrated in FIGS. 6 and 8, respectively.

The height H of the lips 21 is less than the height l of the spikes. The lips 21 at least partially conceal the spikes when the applicator is viewed from the side, perpendicularly to the longitudinal axis X of the core, as illustrated in FIGS. 6 to 8. The spikes 18 are only partially visible in this configuration, such that they are at least partially protected during the wiping of the applicator.

The envelope surface S defined by the free ends of the spikes may, when viewed from the side as in FIG. 3*b*, have an outwardly concave profile, preferably with a slight change in incline close to the distal end.

In the examples which have just been described, applicator members 8 have been illustrated in which the core 10 has an outwardly concave overall shape when viewed in cross section, that is to say in a section extending perpendicularly to the longitudinal axis X of the core 10. In the example in FIGS. 1 to 4, the core 10 has an outwardly concave overall shape both in cross section and in longitudinal section, that is to say in a section extending parallel to the longitudinal axis X of the core.

Figure 9:
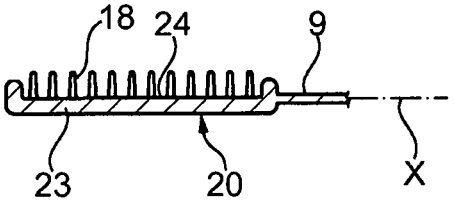

If the core is only concave in cross section and not in longitudinal section, this does not depart from the scope of the present invention. In this case, when viewed in longitudinal section, the surface 24 of the core to which the spikes are attached is straight and parallel to the longitudinal axis X of the core, as illustrated in FIG. 9.

In a further variant, the core may have an outwardly concave overall shape when viewed in longitudinal section, as illustrated in FIG. 10, likewise with curved edges. The edges may be curved about a single axis of curvature, as illustrated in FIG. 10, or about two axes of curvature, as illustrated in FIGS. 10*a* and 10*b*. In FIG. 10*a*, the edges form two curves that are turned towards the same side, and in FIG. 10*b* two opposite curves.

Furthermore, in the example illustrated in FIGS. 1 to 4 in particular, the core has a through-orifice 25. Such an orifice 25 can be in the form of a slot 25*a* that is elongate along the longitudinal axis of the core, as illustrated, such a form being able to make it easier to store and release the product. The width of the slot may vary, being at a maximum approximately half-way along. The slot 25*a* may terminate at its proximal end with a circular edge 25*b*, a narrowing 25*c* being formed between the ends of this circular edge 25*b* and the rest of the slot 25*a*.

The slot 25 may extend along a length along the axis X which is preferably greater than or equal to L/4 and better still between L/2+L/4 and L/2.

In top view, the spikes 18 may be disposed such that their bases do not meet, with a number of spikes 18 in the widthwise direction of the core 10 that can always be less than or equal to 6.

The applicator member 8 may have three rows of spikes 18 on each core portion 130 located to one side of the slot 25.

Within each portion 130, the spikes 18 of the rows are disposed in staggered rows.

Away from the portions 130, the spikes 18 are disposed substantially with a regular spacing in the lengthwise and widthwise directions.

In a variant, it is possible for the core not to have a through-orifice, as illustrated in FIG. 11.

It is possible for the core to only have spikes 18 disposed inside the cavity 20, as illustrated above, or, in a variant, it may carry spikes 19 on the side away from its cavity 20, as illustrated in FIG. 12. These spikes 19 may be substantially divergent, as illustrated, or parallel to one another, or in a further variant they may converge towards one another.

The height of the spikes 18 may decrease towards the distal end 12 of the core 10, as can be seen in FIG. 2, so as to facilitate insertion into the container 3. In one exemplary embodiment that is not illustrated, the height of the spikes 18 decreases towards the stem 7, so as to make it easier for the applicator member 8 to pass the wiping member 6 while the applicator 2 is being withdrawn from the container 3.

The spikes 18 may have various shapes. In the example in question, the spikes 18 have a conical shape. However, the invention is not limited to one particular shape of spikes.

The wiping member 6 may be made of elastomer. The wiping member 6 may have a wiping orifice 6*a* with a circular shape, optionally with slots. The diameter of the wiping orifice 6*a* of the wiping member 6 is for example between 3 and 5.5 mm, for example around 4.5 mm or 5 mm.

The wiping member 6 may optionally have undulations, allowing the wiping orifice to widen more easily when the applicator member 8 passes through. The wiping orifice may thus be defined by an undulating wiping lip that has a radially inner free edge that defines the wiping orifice 6*a*. The wiping member 6 may have between 3 and 12 undulations, for example. The wiping lip may extend generally in the form of a cone converging in the direction of the bottom of the container 3, having a generatrix that forms an angle with the longitudinal axis of the container 3. The diameter of the wiping orifice 6*a* increases for example from 4 mm to 5.5 mm without excessive deformation of the wiping member 6, as the applicator member 8 passes through, by deployment of the undulations.

The wiping member may also be adjustable, if appropriate.

The wiping member may for example be as described in the patent applications or patents U.S. 2005/0028834, U.S. 2005/0175394, U.S. 2004/0258453, U.S. Pat. Nos. 6,375,374, 6,328,495, 7,455,468.

The stem 7, to which the applicator member 8 is fixed, may be at least partially, and in particular completely, flexible, in particular in the vicinity of the applicator member.

In order to mould the applicator member 8, use can be made of any thermoplastic material which is or is not relatively rigid, for example SEBS, a silicone, latex, a material having improved slip, butyl, EPDM, a nitrile, a thermoplastic elastomer, a polyester elastomer, a polyamide elastomer, a polyethylene elastomer or a vinyl elastomer, a polyolefin such as PE or PP, PVC, EVA, PS, SEBS, SIS, PET, POM, PU, SAM, PA or PMMA. It is also possible to use a ceramic, for example based on alumina, a resin, for example of the urea-formaldehyde type, and possibly a material containing graphite as filler. It is possible in particular to use the materials known under the trade names Teflon®, Hytrel®, Cariflex®, Alixine®, Santoprene®, Pebax® and Pollobas®, this list not being limiting.

Of course, the invention is not limited to the examples which have just been described, the characteristics of which may be combined with one another as parts of variants which are not illustrated.

The applicator member may be mounted in various ways on the stem 7 and, for example, the stem 7 may have a flexible distal portion, optionally provided with an annular groove.

The applicator member 8 may comprise any bactericidal agent such as silver salts, copper salts, preservatives and at least one preservative for the product P.

The core 10 and/or the spikes 18 may, furthermore, comprise particles, for example a filler, in particular a compound which is magnetic, bacteriostatic or absorbs moisture, or else a compound intended to produce roughness on the surface of the spikes 18 or to help the eyelashes and/or eyebrows to slide on the spikes. At least one of the core 10 and a spike may be flocked, receive any heat or mechanical treatment, and/or comprise particles, for example a filler, in order in particular to improve the sliding of the applicator member 8 on the eyelashes and/or eyebrows.

The expression "having a" should be understood as being synonymous with "having at least one", and "between" is understood as including the limits, unless specified to the contrary.

The invention claimed is:

1. Applicator for applying a cosmetic or care product to eyelashes or eyebrows, having a moulded applicator member having:

a core that extends along a longitudinal axis, spikes that are carried by the core and extend from the core, a majority of the spikes being substantially parallel to a reference direction which is a direction of an elongation axis of one of the spikes, elongation axes of the spikes being parallel or slightly inclined with respect to the reference direction at an angle of less than or equal to 15°, the core having, at least in cross section in a plane perpendicular to the longitudinal axis, an outwardly concave overall shape, forming a cavity, spikes being disposed inside the cavity in the core, and the core having a through-orifice.

2. Applicator according to claim 1, wherein the core has an outwardly concave overall shape when viewed in longitudinal section.

3. Applicator according to claim 1, wherein the core only has an outwardly concave overall shape in cross section in the plane perpendicular to the longitudinal axis and not in longitudinal section in an axial median plane passing through the longitudinal axis.

4. Applicator according to claim 1, wherein the spikes are flush with or project beyond the core when the applicator is viewed in side view perpendicularly to the longitudinal axis of the core.

5. Applicator according to claim 1, wherein the core has at least one lip, extending substantially longitudinally and laterally delimiting the cavity.

6. Applicator according to claim 5, wherein the lip or lips are attached to a bottom wall, said bottom wall being planar, concave or convex towards the inside of the cavity.

7. Applicator according to claim 1, wherein the orifice is located in a bottom of the cavity.

8. Applicator according to claim 7, wherein the through-orifice separates two portions of the core, the spikes being disposed in staggered rows on each portion, a number of rows extending along the longitudinal axis and carried by each portion being between 1 and 4.

9. Applicator according to claim 1, wherein the core carries spikes on a side away from the cavity.

10. Applicator according to claim 1, wherein the applicator member has no spikes on a side away from the cavity.

11. Applicator according to claim 1, wherein the core has a tapered free end.

12. Applicator according to claim 1, wherein a free end of the spikes defines an envelope surface having an outwardly concave profile when the applicator member is viewed from a side.

13. Applicator according to claim 1, wherein edges of the core are rectilinear over a major part of a portion of the core carrying the spikes.

14. Applicator according to claim 1, wherein edges of the core are not rectilinear.

15. Applicator according to claim 1, wherein some spikes are partially concealed by the core when the core is viewed from a side in a direction perpendicular to the longitudinal axis of the core and to the direction of elongation of the spikes.

16. Device for packaging and applying a product to eyelashes or eyebrows, having an applicator according to claim 1 and a container containing the product.

17. Applicator according to claim 1, wherein the through-orifice separates two portions of the core, the spikes being disposed on each portion in at least two rows extending along the longitudinal axis and around the through-orifice.

* * * * *